United States Patent [19]

Weinerman et al.

[11] Patent Number: 4,850,209

[45] Date of Patent: Jul. 25, 1989

[54] LATCH AND LOCK HOUSINGS, HANDLES AND MOUNTING BRACKETS

[75] Inventors: Lee S. Weinerman, Medina; Steven A. Mayo, Akron; Joel T. Vargus, Middleburg Heights; Frank R. Albris, Parma, all of Ohio; Richard H. Russell, Farmington, Conn.; Thomas V. McLinden, Oxford, Conn.; Richard M. O'Grady, Southington, Conn.; Timothy H. Wentzell, South Windsor, Conn.

[73] Assignee: The Eastern Company, Cleveland, Ohio

[21] Appl. No.: 72,176

[22] Filed: Jul. 10, 1987

Related U.S. Application Data

[63] Continuation-in-part of Ser. No. 859,194, Apr. 28, 1986, Pat. No. 4,683,736, which is a continuation-in-part of Ser. No. 601,648, Apr. 18, 1984, abandoned.

[51] Int. Cl.[4] ..... E05B 13/10

[52] U.S. Cl. ..... 70/208; 70/209; 70/210; 70/83; 70/451; 292/227; 292/228; 292/DIG. 31

[58] Field of Search ..... 70/81, 83, 84, 208–210, 70/431, 451, 466, 489; 292/DIG. 31, 37, DIG. 63, 224, 240–242, 227, 228

[56] References Cited

U.S. PATENT DOCUMENTS

| | | | |
|---|---|---|---|
| D. 196,424 | 10/1963 | Are | D10/8 |
| D. 210,152 | 2/1968 | Pastva | D50/5 |
| D. 210,153 | 2/1968 | Pastva | D50/5 |
| D. 218,672 | 9/1970 | Lauper | D8/109 |
| D. 230,132 | 1/1974 | Pastva | D8/109 |
| D. 265,965 | 8/1982 | Davis et al. | D8/302 |
| D. 270,328 | 8/1983 | Davis et al. | D8/302 |
| D. 271,562 | 11/1983 | Weinerman | D8/338 |
| D. 292,482 | 10/1987 | Weinerman et al. | D8/302 |
| 1,995,106 | 3/1935 | Roedding | 292/227 X |
| 2,266,119 | 12/1941 | Jacobi | 292/227 |
| 2,317,700 | 4/1943 | Thompson | 292/254 |
| 2,387,187 | 10/1945 | Smith | 70/97 |
| 2,594,940 | 4/1952 | Levine | 70/66 |
| 2,637,585 | 5/1953 | Troche et al. | 292/336.3 |
| 2,642,300 | 6/1953 | Pelcin | 292/173 |
| 2,649,322 | 8/1953 | Mack | 292/173 |
| 2,668,076 | 2/1954 | Troche et al. | 292/336.3 |
| 2,703,431 | 3/1955 | Tatom | 292/DIG. 31 X |
| 2,721,751 | 10/1955 | Holritz | 292/169 |
| 2,735,706 | 2/1956 | Pelcin | 292/34 |
| 2,746,784 | 3/1956 | Holritz | 292/175 |
| 2,763,503 | 9/1956 | Tasch et al. | 292/173 |
| 2,784,993 | 3/1957 | Collar | 292/223 |
| 2,840,407 | 6/1958 | Sellon, Jr. | 292/169 |
| 2,871,048 | 1/1959 | Balogh | 292/173 |

(List continued on next page.)

OTHER PUBLICATIONS

Southco Inc., *Southco Fasteners Handbook* 37, Concordville, PA 19331, date unknown.

Eberhard Manufacturing Co., *Handbook of Latches, Locks, Hinges, Handles, and Related Hardware.*, No. 103, Cleveland, OH 44136, 1985.

Adams Rite Manufacturing Co., *Hardware for Glass Doors that Swing or Slide,* City of Industry, CA 91749, Jan., 1988.

POP Fasteners Division, Emhart Fastener Group, Emhart Corp., *Well-Aid Threaded Inserts* (4 page brochure), Shelton, CT 06484, Nov. 1983.

*Primary Examiner*—Gary L. Smith
*Assistant Examiner*—Suzanne L. Dino
*Attorney, Agent, or Firm*—David A. Burge

[57] ABSTRACT

Flush mountable pulls, latches and locks for industrial cabinets, tool carts, electrical equipment enclosures and the like utilize a versatile housing together with other components of novel form mounted on the housing to provide a variety of desired features. Pull handles as well as latch and lock operating handles of a wide variety of types can be connected to the housing, as can a wide variety of latch bolt mechanisms that are configured to engage various types of strikers or keeper formations. The resulting arrangement provides sturdy pull, latch and lock assemblies that employ a small number of parts that can be assembled, installed and serviced with ease.

28 Claims, 7 Drawing Sheets

U.S. PATENT DOCUMENTS

| | | | |
|---|---|---|---|
| 2,900,204 | 8/1959 | Pelcin | 292/173 |
| 2,916,905 | 12/1959 | Podlesak | 70/150 |
| 2,952,150 | 9/1960 | Matzkin et al. | 70/451 |
| 2,962,320 | 11/1960 | Gilbert | 70/451 X |
| 2,987,908 | 6/1961 | Pelcin | 70/146 |
| 3,044,287 | 7/1962 | Pelcin | 70/99 |
| 3,044,814 | 7/1962 | Pelcin | 292/126 |
| 3,055,204 | 9/1962 | Pelcin | 70/153 |
| 3,081,617 | 3/1963 | McKay | 70/153 |
| 3,111,833 | 11/1963 | Dettmer | 70/208 X |
| 3,209,563 | 10/1965 | Pelcin | 70/146 |
| 3,209,564 | 10/1965 | Pelcin | 70/148 |
| 3,240,523 | 3/1966 | Heimann | 292/241 X |
| 3,338,610 | 8/1967 | Pelcin et al. | 292/126 |
| 3,357,734 | 12/1967 | Pastva, Jr. | 292/165 |
| 3,371,511 | 3/1968 | Atkinson | 70/71 |
| 3,389,932 | 6/1968 | Pastva, Jr. | 292/173 |
| 3,449,005 | 6/1969 | Pastva, Jr. | 292/173 |
| 3,495,862 | 2/1970 | McClintock | 292/173 |
| 3,508,778 | 4/1970 | Legge et al. | 292/DIG. 31 X |
| 3,550,412 | 12/1970 | Pitel et al. | 70/208 X |
| 3,558,167 | 1/1971 | Atkinson | 292/228 |
| 3,576,118 | 4/1971 | Doerrfeld | 70/146 |
| 3,659,445 | 5/1972 | Eads et al. | 70/451 |
| 3,668,907 | 6/1972 | Pastva, Jr. | 70/153 |
| 3,707,862 | 1/1973 | Pastva, Jr. | 70/150 |
| 3,743,336 | 7/1973 | Andrews | 292/173 |
| 3,758,140 | 9/1973 | Prete, Jr. | 292/223 |
| 3,782,141 | 1/1974 | Doerrfeld | 70/146 |
| 3,795,416 | 3/1974 | Hehl et al. | 292/336.3 |
| 3,841,674 | 10/1974 | Bisbing et al. | 292/175 |
| 3,850,464 | 11/1974 | Bisbing et al. | 292/175 |
| 3,857,594 | 12/1974 | Pastva, Jr. | 292/27 |
| 3,871,198 | 3/1975 | Miller | 70/146 |
| 4,021,073 | 5/1977 | Manning | 292/228 X |
| 4,038,718 | 8/1977 | Reilhac et al. | 16/110 |
| 4,116,027 | 9/1978 | Tannery | 70/472 |
| 4,131,002 | 12/1978 | Gianelo | 70/84 |
| 4,132,092 | 1/1979 | Steinbach | 70/208 |
| 4,134,281 | 1/1979 | Pelcin | 70/208 |
| 4,138,869 | 2/1979 | Pelcin | 70/151 |
| 4,170,119 | 10/1979 | Kalis, Jr. | 70/221 |
| 4,177,656 | 12/1979 | Davis | 70/84 |
| 4,231,597 | 11/1980 | Pelcin | 292/164 |
| 4,309,884 | 1/1982 | Davis | 292/DIG. 31 X |
| 4,312,202 | 1/1982 | Pastva, Jr. et al. | 70/472 |
| 4,312,203 | 1/1982 | Davis | 70/472 |
| 4,312,204 | 1/1982 | Davis | 70/472 |
| 4,312,205 | 1/1982 | Reed et al. | 70/472 |
| 4,320,642 | 3/1982 | Pastva, Jr. | 70/472 |
| 4,321,812 | 3/1982 | Pelcin | 70/472 |
| 4,335,595 | 6/1982 | Swan et al. | 70/149 |
| 4,370,874 | 2/1983 | Munn | 70/204 |
| 4,413,849 | 11/1983 | Davis et al. | 292/229 |
| 4,420,954 | 12/1983 | Hieronymi et al. | 70/150 |
| 4,438,964 | 3/1984 | Peters | 70/208 |
| 4,465,328 | 8/1984 | Tihanyi et al. | 312/215 |
| 4,489,904 | 12/1984 | Soederberg | 292/DIG. 31 X |
| 4,492,394 | 1/1985 | Dignan | 292/64 |
| 4,498,319 | 2/1985 | Balducci et al. | 70/489 X |
| 4,510,779 | 4/1985 | Ahad | 70/208 |
| 4,578,968 | 4/1986 | Messier, Jr. | 70/208 |
| 4,671,547 | 6/1987 | Weinerman et al. | 292/197 |
| 4,676,081 | 6/1987 | Craig | 292/DIG. 31 X |
| 4,679,835 | 7/1987 | Weinerman et al. | 292/197 |
| 4,683,736 | 8/1987 | Weinerman et al. | 70/208 |
| 4,693,503 | 9/1987 | Bisbing | 292/DIG. 31 X |
| 4,706,478 | 11/1987 | Swan et al. | 70/208 |
| 4,707,006 | 11/1987 | Garg et al. | 292/DIG. 31 X |

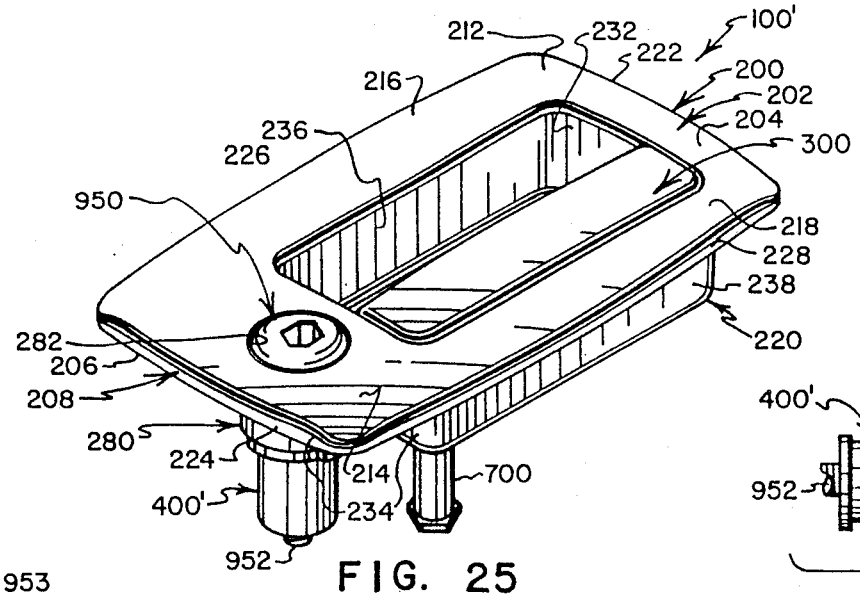
FIG. 25
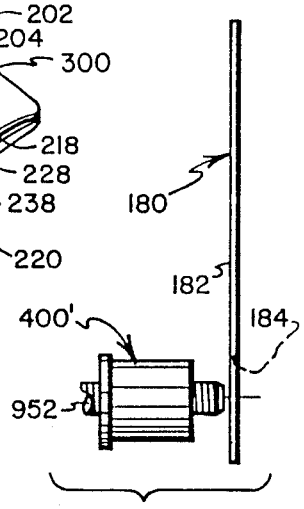
FIG. 27
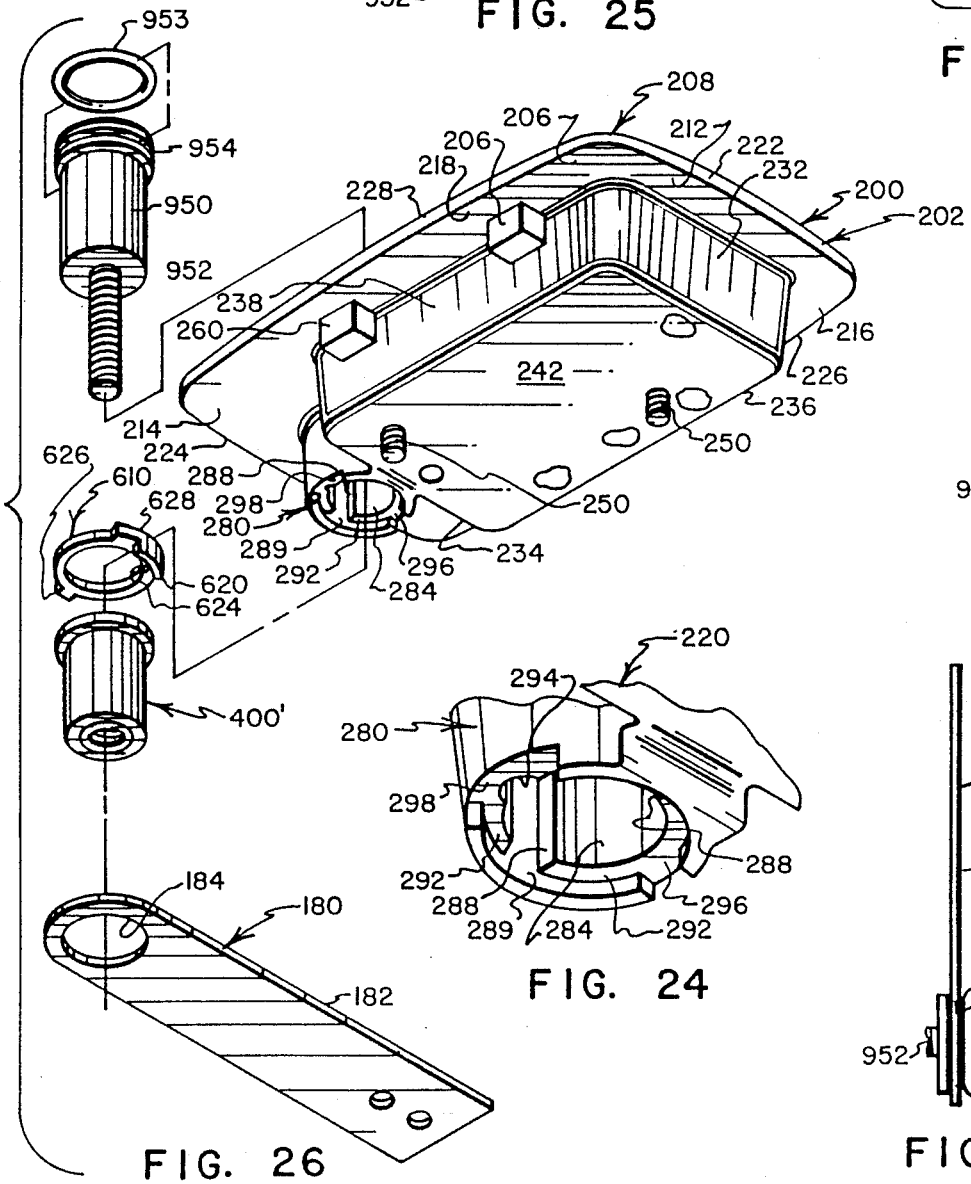
FIG. 26
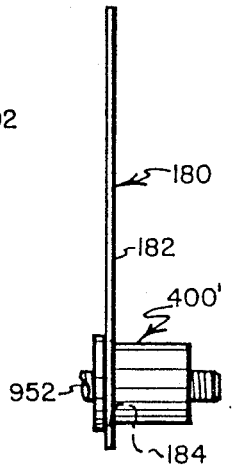
FIG. 28
FIG. 24
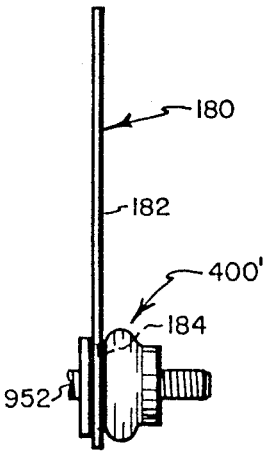
FIG. 29

LATCH AND LOCK HOUSINGS, HANDLES AND MOUNTING BRACKETS

The present application is a continuation-in-part of a co-pending application entitled Cabinet Lock with Recessed Handle, Ser. No. 859,194 filed Apr. 28, 1986 by Lee S. Weinerman et al as a continuation-in-part of application Ser. No. 601,648 filed Apr. 18, 1984 (now abandoned), which applications are referred to hereinafter as the "Parent Cases," the disclosures of which are incorporated herein by reference Application Ser. No. 859,194 issued Aug. 4, 1987 as U.S. Pat. No. 4,683,736.

CROSS-REFERENCE TO RELATED APPLICATIONS

Reference is made to the following related, concurrently-filed applications, the disclosures of which are incorporated herein by reference:

Latch and Lock Assemblies with Spring-Biased Slide Bolts, Ser. No. 072,177, filed July 10, 1987 by Lee S. Weinerman, Steven A. Mayo, Joel T. Vargus, Frank R. Albris, Richard H. Russell, Thomas V. McLinden, Richard M. O'Grady and Timothy H. Wentzell, hereinafter referred to as the "Utility Case II;"

Latch and Lock Assemblies with Spring-Biased Pivot Bolts, Ser. No. 072,174, filed July 10, 1987 by Lee S. Weinerman, Steven A. Mayo, Thomas V. McLinden and Timothy H. Wentzell, hereinafter referred to as the "Utility Case III;"

Latch and Lock Assemblies with Lift and Turn Handles, Ser. No. 072,175, filed July 10, 1987 by Lee S. Weinerman, Frank R. Albris, Thomas V. McLinden and Timothy H. Wentzell, hereinafter referred to as the "Utility Case IV;"

Latch and Lock Assemblies with Expansible Latch Elements, Ser. No. 072,250, filed July 10, 1987 by Lee S. Weinerman, Steven A. Mayo, Thomas V. McLinden and Timothy H. Wentzell, hereinafter referred to as the "Utility Case V;"

Housings for Latches and Locks, Ser. No. 072,282, filed July 10, 1987 by Richard H. Russell, David W. Kaiser and Richard M. O'Grady, hereinafter referred to as the "Design Case I;"

Combined Housings and Handles for Latches and Locks, Ser. No. 072,283, filed July 10, 1987 by Richard H. Russell, David W. Kaiser and Richard M. O'Grady, hereinafter referred to as the "Design Case II;"

Combined Housings and Handles for Latches and Locks, Ser. No. 072,285, filed July 10, 1987 by Richard H. Russell and David W. Kaiser, hereinafter referred to as the "Design Case III;"

Combined Housings and Handles for Latches and Locks, Ser. No. 072,284, filed July 10, 1987 by Richard H. Russell and David W. Kaiser, hereinafter referred to as the "Design Case IV;"

Combined Housings and Handles for Latches and Locks, Ser. No. 072,276, filed July 10, 1987 by Richard H. Russell and David W. Kaiser, hereinafter referred to as the "Design Case V;"

Combined Housings and Handles for Latches and Locks, Ser. No. 072,573, filed July 10, 1987 by Richard H. Russell and David W. Kaiser, hereinafter referred to as the "Design Case VI;"

Combined Housings and Handles for Latches and Locks, Ser. No. 072,277, filed July 10, 1987 by Richard H. Russell and David W. Kaiser, hereinafter referred to as the "Design Case VII;"

Mounting Brackets for Latches and Locks, Ser. No. 072,278, filed July 10, 1987 by Richard H. Russell and Thomas V. McLinden, hereinafter referred to as the "Design Case VIII;"

Mounting Brackets for Latches and Locks, Ser. No. 072,280, filed July 10, 1987 by Richard H. Russell and Thomas V. McLinden, hereinafter referred to as the "Design Case IX;"

Strikers for Use with Latches and Locks, Ser. No. 072,279, filed July 10, 1987 by Lee S. Weinerman and Steven A. Mayo, hereinafter referred to as the "Design Case X;" and, Strikers for Use with Latches and Locks, Ser. No. 072,281, filed July 10, 1987 by Lee S. Weinerman and Steven A. Mayo, hereinafter referred to as the "Design Case XI."

BACKGROUND OF THE INVENTION

1. Field of the Invention

The present invention relates generally to flush mounted pulls, latches and locks of the type used with closures and other relatively movable components of industrial cabinets, tool carts, electrical equipment enclosures and the like. More particularly, the present invention relates to novel and improved pulls, latches and locks that utilize a highly versatile housing together with other interactive components of novel form to selectively provide graspable assist structures for effecting relative movement of various parts of cabinets, enclosures and the like, and/or to provide latches and locks with desired types of latching and locking actions.

2. Prior Art

Flush mounted pulls that are graspable by an operator to effect movement of a door, a drawer or other types of closures are known and take a wide variety of forms. A problem not addressed by prior proposals, however, is the need for a versatile housing that can be assembled with other components to selectively form a pull, a latch or a lock. A further problem not addressed by prior proposals is to provide a pull with a sufficiently versatile housing to enable it to be connected to a latch or lock as by mounting additional components on structure that is already in place on the housing. Still another problem that is not addressed by prior proposals is the need for a pull and housing assembly and a mounting bracket, all of which can be used together with a variety of latch and lock hardware to provide the pull and housing assembly with desired types of latching and lock capabilities.

Flush mounted latches and locks including a body, a latch bolt movably carried on the body, and an operating handle that is nested by the body are well known. Normally the handle is in a flush or nested position when the bolt is in a latched position; and, unlatching movement of the bolt is effected by moving the handle to an operating position. Latches and locks of this type are well suited for use on industrial cabinets, tool carts, electrical equipment enclosures and the like.

Flush-mounted latches and locks having pan-shaped housings that nest paddle-shaped operating handles, and that have spring-projected slide bolts are disclosed in such patents as U.S. Pat. Nos. 4,335,595, 4,321,812, 4,320,642, 4,312,205, 4,312,204, 4,312,203, 4,312,202, 4,309,884, 4,231,597, 4,138,869, 3,707,862, 3,668,907, 3,449,005, 3,389,932, 3,357,734, 3,209,564, 3,209,563, 3,055,204, 2,987,908, 2,900,204 and 2,642,300, all of which are assigned to The Eastern Company, a corporation of Connecticut.

Flush mounted latches and locks having latch bolts of other than the spring-projected, slide-mounted type are disclosed in such patents as U.S. Pat. Nos. 4,413,849, 4,320,642, 4,312,203, 4,134,281, 3,857,594, 3,338,610, 3,044,814, 3,044,287 and 2,735,706, which are assigned to The Eastern Company.

A cabinet latch having a housing that is usable with a variety of pivotally mounted latch bolts, and with a variety of latching mechanisms is disclosed in U.S. Pat. No. 4,177,656, also assigned to the Eastern Company.

Clamping type cabinet latches that have a capability to clamp shut a cabinet door and/or to compress a cabinet door into firm engagement with a resilient door gasket or other seal structure are known. Among the patents that disclose latches that have clamping capabilities are U.S. Pat. Nos. 4,492,394, 4,413,849 and 4,177,656, assigned to The Eastern Company.

3. The Cross-Referenced Utility and Design Cases

The present invention, and the inventions described in the several referenced Utility and Design Cases, represent the work products of a long term and continuing development program.

The several functional features that form the subjects matter of the referenced Utility Cases, and the several appearance features that form the subjects matter of the referenced Design Cases, were developed by various co-workers, as is reflected in the listing of inventors in these cases. Many of the functional and appearance features that are claimed in separate ones of the referenced Utility and Design Cases were developed substantially concurrently.

If an invention feature that is disclosed in one of the referenced Utility and Design Cases constitutes a species of a development concept that is utilized in another of these related cases, it will be understood that care has been taken to present a generic claim in the case that describes the earliest development of a species that will support the generic claim. In this manner, a careful effort has been made to establish clear lines of demarcation among the claimed subjects matter of this and the several referenced Utility and Design Cases. No two of these cases include claims of identical scope.

4. The Referenced Parent Cases

The referenced Parent Cases disclose a simple means for retaining a key cylinder assembly in a lock housing. The lock housing has a generally cylindrical opening formed therethrough that extends along an axis for mounting a key cylinder assembly for rotation about the axis. Axially extending grooves are formed in an internal wall that defines the cylindrical opening. One of the grooves (referred to as an "installation groove") extends rearwardly and opens through such rear wall portions of the housing as surround the cylindrical opening. The grooves serve the function of cooperating with key operated tumblers of the key cylinder assembly that project radially from opposed sides of the key cylinder assembly to selectively permit and prevent rotation of the key cylinder assembly relative to the housing. The installation groove serves the function of permitting an offset projection that is carried on the back of the key cylinder assembly to be inserted completely through the cylindrical opening of the housing as the key cylinder assembly is installed in the cylindrical opening. Once the key cylinder assembly is installed, it is rotated to position the offset projection out of alignment with the installation groove so that the offset projection extends in overlying relationship with such rear wall portions of the housing as surround the cylindrical opening in which the key cylinder assembly is installed. By this arrangement, so long as the key cylinder is prevented from rotating relative to the housing to a position where the offset projection aligns with the installation groove, the offset projection serves to retain the key cylinder assembly in place on the housing.

As will be explained in greater detail, the type of housing features that are described above, and that also are disclosed in the referenced Parent Cases, are utilized in the preferred practice of the present invention. For this reason, the present application is being filed as a continuation-in-part case, with the benefits of the filing dates of the referenced Parent Cases being claimed.

SUMMARY OF THE INVENTION

The present invention provides novel and improved flush mountable pulls, latches and locks for industrial cabinets, tool carts, electrical equipment enclosures and the like, with the pulls, latches and locks utilizing a highly versatile housing together with other interactive components of novel form.

A pull latch or lock embodying the preferred practice of the present invention includes a one-piece housing that is formed from molded plastics material, and on which are mounted other interactive components that provide a variety of desired features. As will become apparent from the description that follows, the versatile housing that is used with pulls, latches and locks that embody the preferred practice of the present invention provides a rigid, sturdy structure for securely supporting pull, latch and lock components. Pulls, latches and locks that embody the preferred practice of the present invention advantageously employ small numbers of parts that can be assembled with ease.

The versatile housing on which other components are mounted preferably is formed from a suitable thermoplastics material such as a glass reinforced polycarbonate based polymer blend, which provides a dimensionally stable, impact resistant structure that is rigid, strong and can be readily machined as may be needed to provide mounting formations for handles as well as latch and lock components of a wide variety of types. The molded housing defines a pan-shaped structure that has a forwardly facing recess for nesting a handle. A pair of threaded mounting studs have enlarged head portions that are embedded in the molded material of the housing so that the threaded studs project rearwardly from a back wall of the housing for receiving mounted posts that are threaded onto the studs for mounting latch and lock operating components, and/or for establishing connections with a mounting bracket.

While some of the latch and lock structures that embody the preferred practice of the present invention have pivotally mounted latch arms, many features of the invention are not limited to use with a particular type of latch or lock, as will be apparent to those skilled in the art from the description and claims that follow.

BRIEF DESCRIPTION OF THE DRAWINGS

These and other features, and a fuller understanding of the invention may be had by referring to the description and claims that follow, taken in conjunction with the accompanying drawings, wherein:

FIG. 24 is a perspective view of a latch assembly that utilizes the housing and handle assembly of FIGS. 7-16 together with other components, with the view showing principally front features thereof;

FIG. 25 is an exploded view showing the components that are added to the housing and handle assembly of FIGS. 7-16 to form the latch assembly of FIG. 25, with the view showing principally rear features thereof;

FIG. 26 is an exploded view showing the components of a latch member and a keeper;

FIG. 27 is a side elevational view of portions of the latch assembly of FIG. 25 together with a keeper of the type that is depicted in FIG. 26, with the latch components out of engagement with the keeper;

FIG. 28 is a side elevational view similar to FIG. 27 but with the latch components releasably engaging with the keeper; and, FIG. 29 is a side elevational view similar to FIG. 28 but with the latch components clampingly engaging the keeper.

DESCRIPTION OF THE PREFERRED EMBODIMENT

Figure 1:
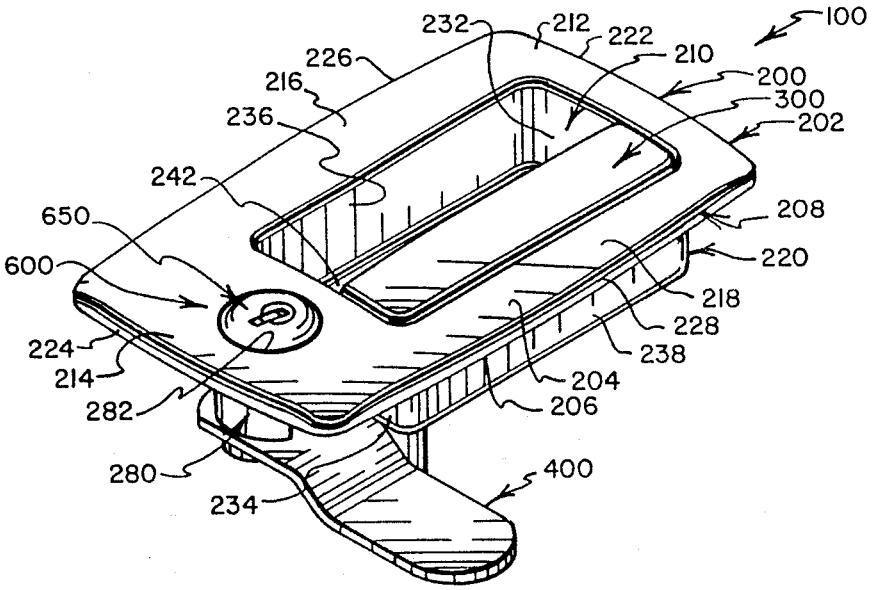
FIG. 1 is a perspective view of a lock assembly embodying one form of our design, with the view showing principally front features thereof.

Referring to FIG. 1, one form of a lock assembly that embodies features of the preferred practice of the present invention is indicated generally by the numeral 100. The lock assembly 100 has a housing 200 that mounts a plurality of interactive components that provide latching and locking functions.

In overview, and as will be explained in greater detail, the interactive components that are carried on the housing 200 principally include a handle 300 that is mounted on the housing 200; a pivotal latch bolt 400 that is mounted on the housing 200 so as to be pivotally movable relative thereto; and a locking mechanism 600 for selectively permitting and preventing latching and unlatching movements of the latch arm 400.

In another embodiment that is depicted in FIG. 25 (for purposes of illustrating the versatility of the housing and handle assembly) a latch assembly 100′ includes the housing 200, the handle 300, and has a resilient, expansible latch member 400′ that is mounted on the housing 200 (as by being threaded onto a shank 952 of a plug 950 that is journaled by the housing sleeve 280 so that rotation of the plug 950 and shank 952 will effect latching and unlatching movement of the resilient latching member 400′) for expansion and contraction movements between what will be referred to as a "latched" position (as shown in FIG. 29) and an "unlatched" position (as shown in FIGS. 25, 27 and 28); and, a latch operating mechanism 600′ (which is depicted as including a tool rotated plug 950, but which can just as easily utilize a key operated cylinder assembly to rotate the shank 952) can include a key lock, not shown) for selectively permitting and preventing latching and unlatching (i.e., "expansion" and "contraction") movements of the resilient latch member 400′.

Figure 6:
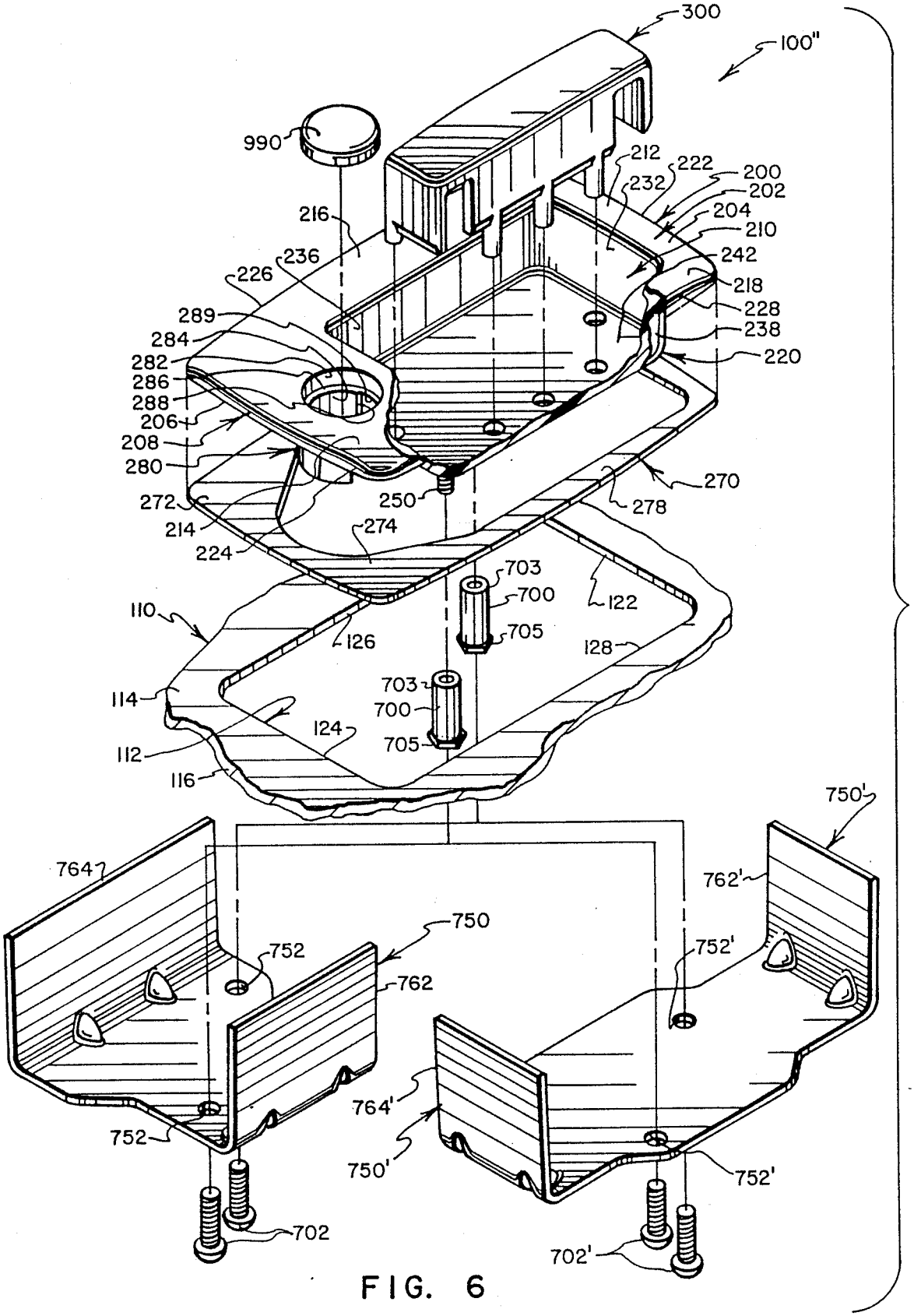
FIG. 6 is an exploded perspective view of a pull assembly that utilizes features of the invention, with the view showing principally front features thereof, with housing portions broken away, and with the view showing alternate forms of mounting brackets that can be employed.

As still another example of the versatility of the housing 200, reference is made to FIG. 6 wherein the housing 200 and the handle 300 are shown in a form that provides a simple handle—i.e., a pull assembly 100″.

Appearance features of the combined housing and handle (i.e., the housing 200 and the handle 300) are shown in greater detail in the referenced Design Case V.

Referring to FIG. 25, it will be seen that, in the latch embodiment 100″, the resilient latch member 400′ projects relatively rearwardly with respect to the housing 200 for engaging a suitably configured keeper 180 or other structure that is located adjacent the latch assembly 100 when a closure (not shown), on which the latch assembly 100 is mounted, is "closed."

The keeper 180 has an elongate body structure 182 that surrounds and defines a latch-member receiving opening 184 that is of adequate size to receive a cylindrical body portion of the latch member 400, and to releasably retain the latch member 400 when the latch member 400 has been expanded while extending through the opening 184.

The manner in which the latch member 400 engages, expands within and contracts within the keeper opening 184 is illustrated in FIGS. 27-29. In FIG. 27, the latch member 400′ is shown separated from the keeper 180 but aligned with the keeper opening 184. In FIG. 28 the latch member 400′ is shown inserted through the keeper opening 184. In FIG. 29, the latch member 400′ is shown in latched or expanded relationship with the keeper 180 to securely grip the keeper 180.

Expansion and contraction movement of the latching member 400' (which does not rotate relative to the housing 200) is effected by rotating the plug 950 and its rigidly attached shank 952. A groove 954 is provided in the head of the plug 950 to receive an O-ring 953.

Figure 2:
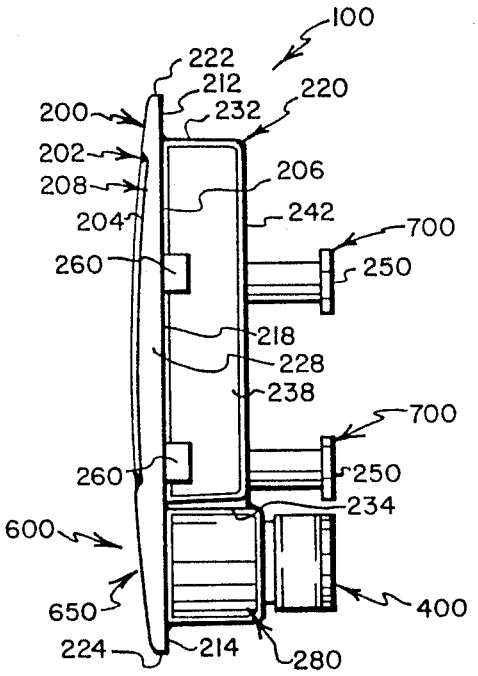
FIG. 2 is a right side elevational view thereof.
Figure 5:
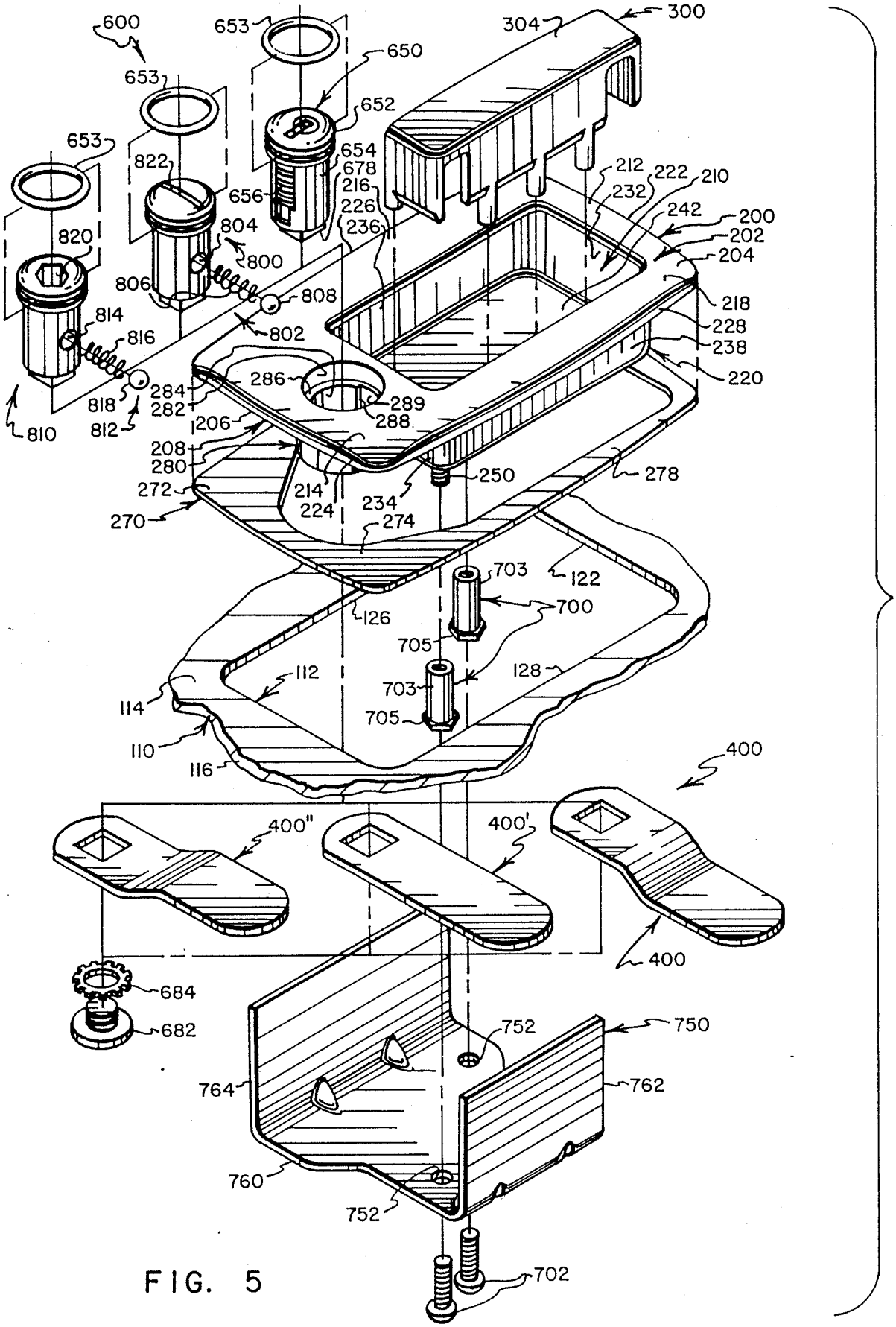
FIG. 5 is an exploded perspective view thereof, and with the view illustrating how the lock assembly is mounted on a closure, and with the view illustrating various alternate forms of latch and lock parts that can be used therewith.

Returning to the lock assembly 100 that is depicted in FIGS. 1 and 2, the preferred manner in which the lock assembly 100 can be mounted on a closure will be described. Referring to FIG. 5, a closure portion 110 is shown that has a mounting opening 112 formed therethrough. The closure portion 110 has a front surface 114 and a rear surface 116 that extend about the perimeter of the opening 112. The opening 112 has top and bottom boundaries 122, 124, and left and right side boundaries 126, 128.

In order to mount the lock assembly 100 on the closure 110, the lock assembly 100 has a pair of mounting posts 700 that project rearwardly for connection to a mounting bracket 750. The mounting bracket 750 is of generally U-shaped configuration, having a back wall 760 that connects at opposite ends with legs 762, 764. The legs 762, 764 extend forwardly from the plane of the back wall 760 toward the mounting flange 202, and cooperate with the housing 200 for clampingly mounting the lock assembly 100 on the closure 110. Appearance features of the mounting bracket 750 are disclosed in greater detail in the referenced Design Case IX.

When the lock assembly 100 is to be installed on the closure 110, a gasket 270 is positioned to engage the mounting flange 202, and portions of the lock assembly 100 are installed through the closure opening 112 to position the gasket 270 adjacent the opening 112 in clamped engagement between the rear face 206 of the mounting flange 202 and the front surface 114 of the closure 110. The mounting bracket 750 is positioned to overlie the lock assembly 100, with the legs 762, 764 of the mounting bracket 750 extending into engagement with the rear surface 116 of the closure 110. Threaded fasteners 702 are installed to extend through holes 752 that are formed through the back wall 760 of the bracket 750. The fasteners 702 are threaded into the mounting posts 700 of the lock assembly 100 to clamp the mounting flange 202 into engagement with the gasket 270, to clamp the gasket 270 into engagement with the front surface 114, and to clamp the legs 762, 764 into engagement with the rear surface 116.

Turning now to a more detailed description of features of the components of the lock assembly 100, the housing 200 is preferably formed as a molded, one piece structure; thus it will be understood that the mounting flange 202 together with the walls that form an essentially pan-shaped housing portion 220 (i.e., the walls that define the width, length and depth of the recess 210) are integrally-formed parts of the same one-piece structure. The fabrication of the housing as a one-piece member molded from thermoplastic, material such as a glass reinforced polycarbonate based polymer blend helps to provide a strong, rigid, impact resistant structure, whereby the housing 200 is capable of providing a versatile mounting platform for supporting the various relatively movable components of the lock assembly 100.

A preferred material from which the housing 200 is formed is a thermoplastic that is a glass reinforced polycarbonate based polymer blend, typically of the type sold by General Electric Company, Pittsfield, MA 01201 under the registered trademark Xenoy. The most preferred resin blend is about 10 percent glass reinforced, and is selected from the "6000 Series" of the Xenoy products sold by General Electric, with Xenoy 6240 being preferred. While many other commercially available moldable plastics materials can be used to form the housing 200, as will be apparent to those skilled in the art, the preferred material helps to provide a high strength housing that is light in weight, resists crazing and hardening, is heat and chemical resistant, is resistant to impact, and can be machined as needed to provide suitable mounting holes and the like for movably mounting a wide variety of handles within the confines of the recess 210, as will be explained.

Referring to FIGS. 7–17 which disclose features of the housing 200, the mounting flange 202 has a front face 204 that defines the front of the housing 200. The mounting flange 202 has a rear face 206 that is substantially flat, i.e., all portions of the rear face 206 extend substantially in a single plane. The mounting flange 202 is bordered by a perimetrically extending edge surface 208 that joins the front and rear surfaces 204, 206 at their peripheries. While all portions of the mounting flange 202 are formed integrally and therefore serve to define elements of a one-piece structure, for purposes of reference, the mounting flange 202 can be thought of as having a top portion 212 that extends across the top of the recess 210, a bottom portion 214 that extends across the bottom of the recess 210, and opposed side portions 216, 218 that extend along left and right sides of the recess 210. Likewise, the edge surface 208 can be thought of as having a top portion 222, a bottom portion 224, and opposed side portions 226, 228. The flange portions 212, 214, 216, 218 and their associated edge portions 222, 224, 226, 228 cooperate to define a mounting flange 202 that has a generally rectangular configuration, with corner regions where adjacent ones of the edge portions 222, 224, 226, 228 join preferably being gently rounded to give an enhanced appearance.

The pan-shaped portion 220 of the housing 200 (i.e., the portion of the housing 200 that defines the forwardly facing recess 210) includes a top wall 232, a bottom wall 234, a pair of opposed side walls 236, 238, and a back wall 242. The back wall 242 is arranged so that it extends substantially parallel to the rear face 206 of the mounting flange 202. Stated in another way, the back wall 242 has a front face 244 and a rear face 246 that extend in planes that substantially parallel the plane of the rear face 206. Particular attention is paid to the molding of the rear face 246 of the back wall 242 so that the rear face 246 provides a smooth, planar back wall surface that can be utilized for the important functions of mounting and guiding the movement of other components of the lock assembly 100, as will be explained.

For the purpose of providing an enhanced appearance, it is preferred that front face 204 of the housing 200 be of curved, slightly convex configuration. Stated in another way, the front face 204 is convexly curved such that the thicknesses of the mounting flange portions 212, 214, 216, 218 increase progressively the closer these formations extend toward an imaginary center point of the front face 204. Likewise, the thicknesses of the mounting flange portions 212, 214, 216, 218 decreases progressively as these formations extend toward the edge surface portions 222, 224, 226, 228. Preferably, the thicknesses of the mounting flange portions 212, 214, 216, 218 as measured at locations that are adjacent to the edge portions 222, 224, 226, 228, are substantially uniform all along the edge surface 208—which is to say that the edge surface 208 has a width that is substantially constant as the edge surface 208 extends about the housing 200. Appearance features of the front face 204 of the housing 200 are within the purview of the referenced Design Case I.

For the purpose of providing an enhanced appearance, the positioning of the top and bottom walls 232, 234 of the pan-shaped housing portion 220 that defines the recess 210 preferably is asymmetrical relative to top and bottom edges 222, 224 of the mounting flange 202. Likewise, for purposes of enhanced appearance, the positioning of the left and right side walls 236, 238 of the pan-shaped housing portion 220 preferably is asymmetrical relative to the left and right opposed side edges 226, 228 of the mounting flange 202. This absence of symmetry in locating the recess 210 relative to opposed top and side edge portions 222, 224 and 226, 228 of the mounting flange 202 results in the top wall portion 212 being relatively short in height in comparison with the relatively tall height of the bottom wall portion 214 that depends beneath the recess 210, and results in the left sidewall portion 216 being relatively wide, while the right side wall portion 218 is relatively narrow.

Several functional features of the housing 200 are arranged substantially symmetrically about the center plane 201, including the side walls 236, 238 of the housing portion 220, and a sleeve-like housing formation 280, which will be described. With respect to the side-to-side positioning of the recess 210 relative to features of the mounting flange 202, however, it will be understood that this is a feature dictated solely by appearance considerations, and not by functional considerations. Indeed, functional features of the lock assembly 100 would not be affected if the narrow flange portions 212, 218 were enlarged to give the flange portions 212, 218 widths that are equivalent to the relatively wider flange portions 214, 216, respectively. Likewise the styling of the front face 204 of the mounting flange 202 is dictated entirely by appearance considerations.

Figure 17:
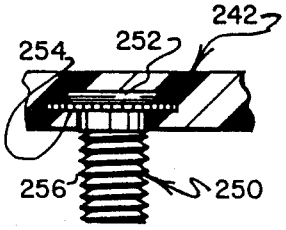
FIG. 17 is an enlargement of a portion of the sectional view of FIG. 16.
Figure 15:
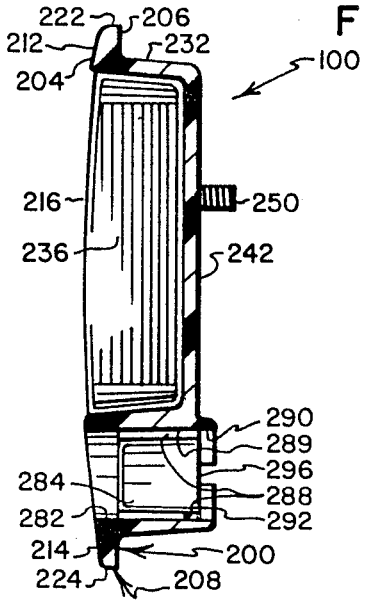
FIG. 15 is a sectional view as seen from a plane indicated by a line 14—14 in FIG. 7.
Figure 16:
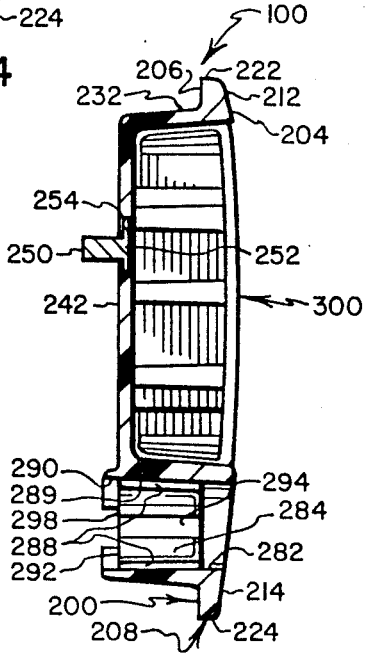
FIG. 16 is a sectional view as seen from a plane indicated by a broken line 15—15 in FIG. 8.
Figure 18:
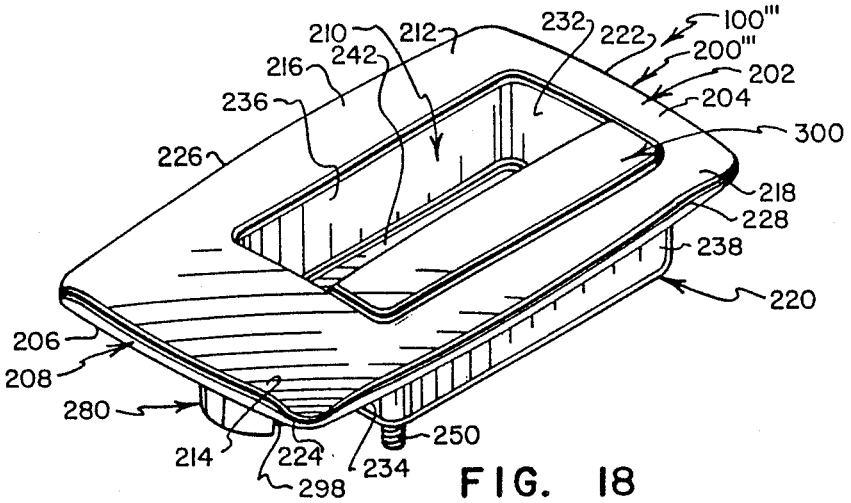
FIG. 18 is a perspective view of an alternate form of assembly used to form a pull, and embodying features of the present invention, with it being understood that the embodiment shown in FIG. 8 differs from the embodiment of FIG. 7 only in that there is no hole in the front wall that needs to be closed by a plug, and with the view showing principally front features of the assembly.
Figure 19:
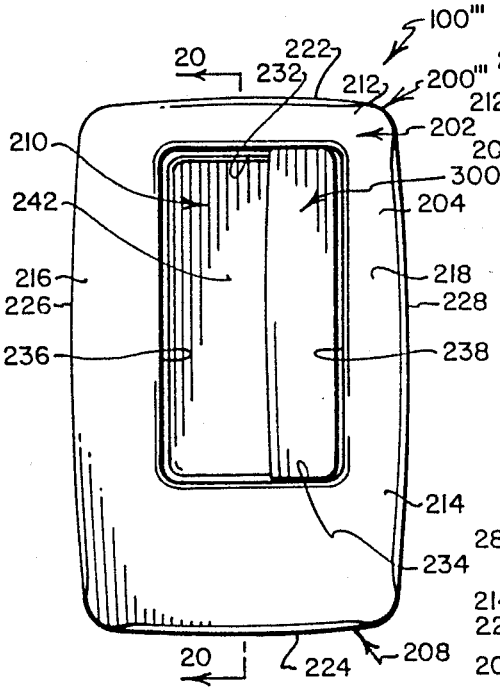
FIG. 19 is a front elevational view thereof.
Figure 20:
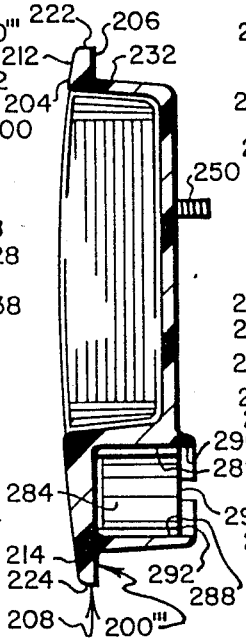
FIG. 20 is a sectional view as seen from a plane indicated by a line 18—18 in FIG. 17.
Figure 21:
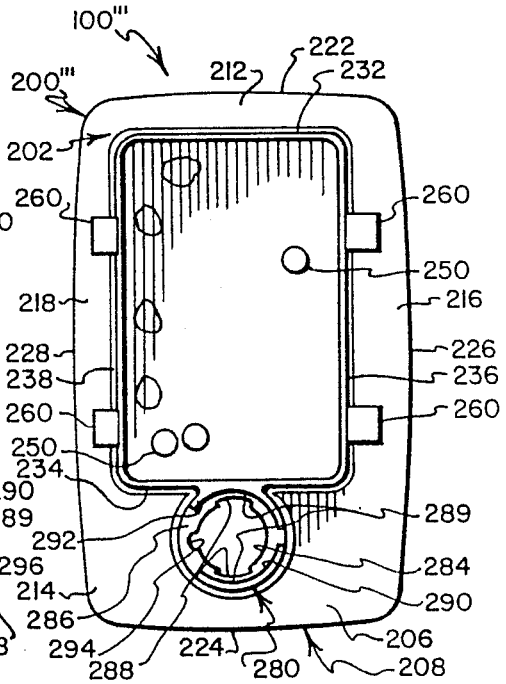
FIG. 21 is a rear elevational view thereof.
Figure 22:
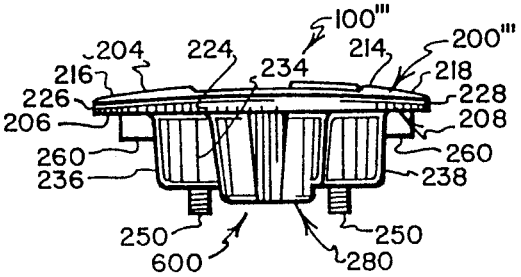
FIG. 22 is a bottom plan view thereof.
Figure 23:
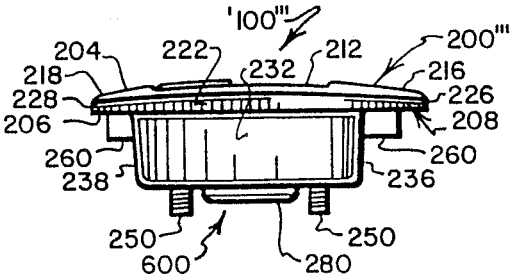
FIG. 23 is a top plan view thereof.

Threaded studs 250 project rearwardly from the rear face 246 of the back wall 242 for mounting various latch and lock components, as will be explained. Referring to FIG. 17, the threaded studs 250 have enlarged head portions 252 with radially outwardly extending projections 254 that have somewhat of a toothed washer appearance and that are located adjacent the head portions 252. The head portions 252 and the projections 254 are embedded within the molded material of the back wall 242 of the housing 200 to provide structures that are anchored securely to the plastics material and will not rotate with request thereto. The studs 250 have elongate threaded shank portions 256 that project rearwardly from the head portions 252. The threaded shank portions 256 extend along spaced imaginary axes 251 that intersect the plane of the back wall 242 at right angles thereto. The axes 251 extend coaxially through the holes 752 that are formed in the back wall 760 of the mounting bracket 750. The axes 251 of the studs 250 are located equidistantly from the center plane 201, and are positioned on opposite sides of the center plane 201.

In preferred practice, the threaded studs 250 are commercially available fasteners that are sold by Penn Engineering and Mfg. Corp. of Danboro, PA, under the trademark PEM. The preferred part is model number CHN-832-4, which is formed from stainless steel, has a tapered head 252 with a maximum diameter of about 0.289 inch, has radially extending projecting portions 254 that have a maximum outer diameter of about 0.328 inch, and has a shank length of about 0.250 inch that is threaded with a standard thread such as 8-32 NC. While these commercially available fasteners are intended for use with sheet metal, not plastic, they have been found to be quite suitable for use in the application described here.

Locator projections 260 are provided at spaced locations along the side walls 236, 238 at junctures of the side walls 236, 238 with the rear face 206 of the mounting flange 202. As will be seen in FIG. 11, the locator projections 260 are arranged symmetrically in pairs on opposite sides of the center plane 201. The locator projections 260 are intended to directly engage opposite sides 126, 128 of the opening 112 to orient the lock assembly 100 properly on the closure 110; however, if the opening 112 has been formed so as to be slightly "oversized," the locator projections 260 may be utilized during installation of the lock assembly on the closure 110 as "guides" to visually aid in properly positioning the housing 200 with respect to the closure opening 112, preferably with the locator projections 260 being arranged to be spaced substantially equidistantly from opposite side portions 126, 128 of the opening 112.

Referring to FIG. 5, while the gasket 270 is not essential in many applications where the lock assembly 100 can be used, the gasket 270 preferably is used in applications that present a possibility that moisture may penetrate the opening 112 as by passing between the back face 206 of the mounting flange 202 and the front face 114 of the closure 110. To aid in properly positioning the gasket 270 about the lock assembly 100, the gasket 270 has an asymmetrical configuration that causes the gasket 270 to extend in an obviously skew, out-of-alignment relationship with respect to the edge portions 226, 228 of the mounting flange 202 if the gasket 270 is installed incorrectly, e.g., in an "inside- out" manner. Specifically, referring to FIGS. 1 and 2, the gasket 270 has a relatively wide left side portion 276 that underlies the relatively wide left side wall 236; similarly, the gasket 270 has a relatively narrow right side portion 278 that underlies the relatively narrow right side wall 238. Further, the gasket 270 has a relatively large, generally triangular-shaped corner region 272 that is configured to underlie a correspondingly large corner portion of the bottom wall 214 of the mounting flange 202, and a relatively smaller, generally triangular shaped corner region 274 that is configured to underlie a correspondingly smaller corner portion of the bottom wall 214 of the mounting flange.

The sleeve-like formation 280 of the housing 200 is located below the recess 210 and extends rearwardly from the rear face 206 of the mounting flange 202 along the bottom wall 234 of the housing portion 220. In preferred practice, the sleeve formation 280 is provided on the housing 200 regardless of whether the sleeve formation 280 is to be utilized to house operating components of a latch or lock.

If the sleeve formation 280 is to be utilized to house latch or lock components, an opening 282 is formed through the front wall 204 to communicate with a passage 284 that extends through the sleeve formation 280. The opening 282 and the passage 284 extend coaxially along an imaginary axis 281 that lies within the imaginary center plane 201 and that extends substantially perpendicular to the planes of the rear face 206 and the back wall 246. If the sleeve formation 280 is not to be utilized to house latch or lock components, either no opening 282 is formed through the front wall 204, or a suitably configured plug (not shown) is installed in the opening 282 to close the opening 282.

Figure 7:
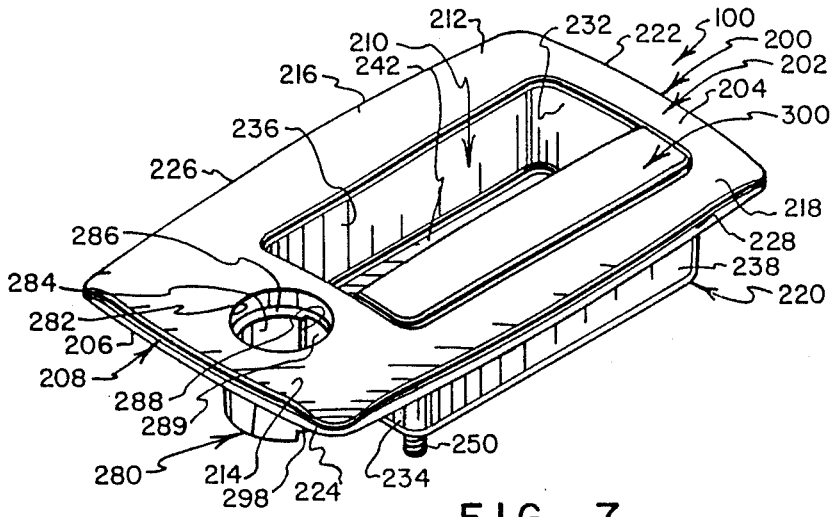
FIG. 7 is a perspective view of a housing and handle assembly that is utilized in the lock, latch and pull embodiments of FIGS. 1-7, with a plug being provided to close a front wall opening, and with the view showing principally front features of the assembly.
Figure 8:
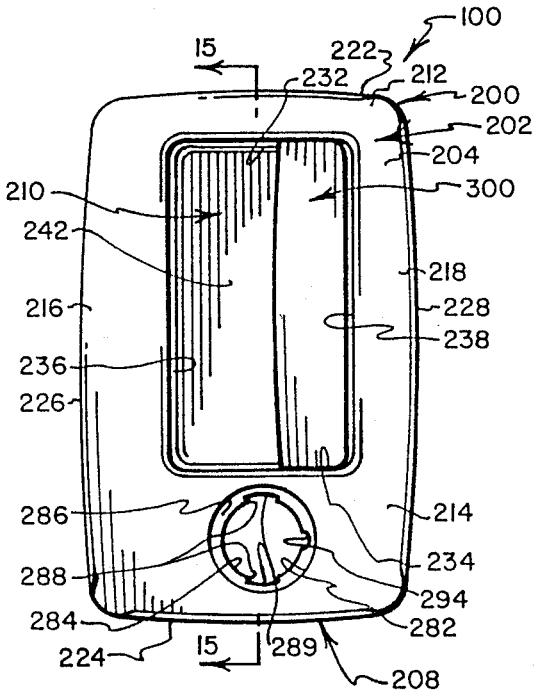
FIG. 8 is a front elevational view thereof.
Figure 9:
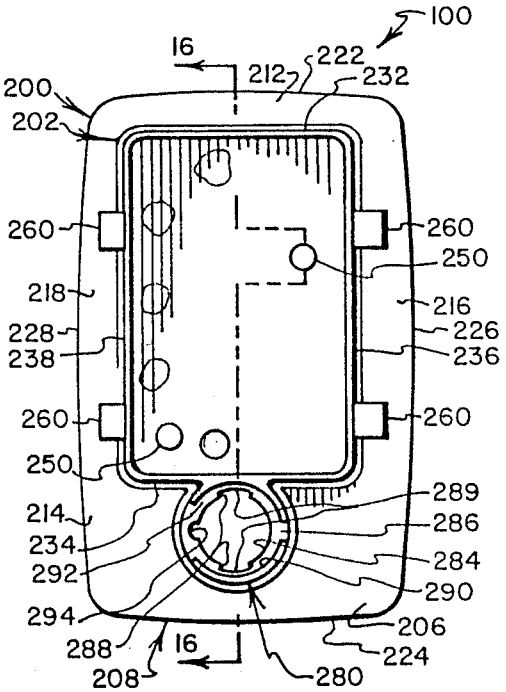
FIG. 9 is a rear elevational view thereof.
Figure 10:
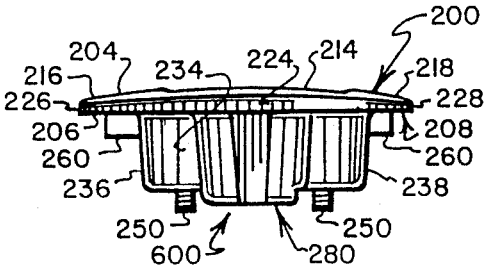
FIG. 10 is a bottom plan view thereof.
Figure 11:
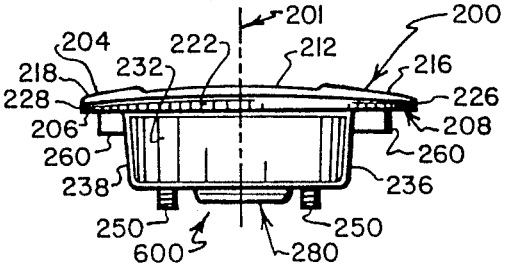
FIG. 11 is a top plan view thereof.
Figure 12:
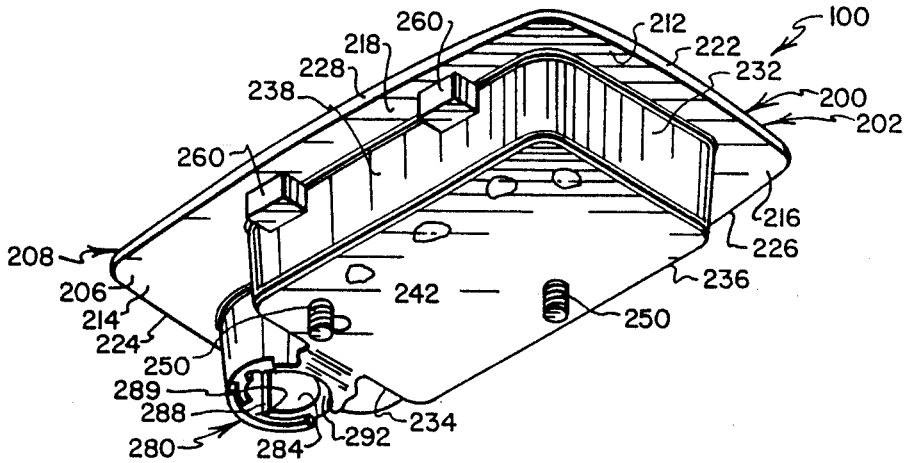
FIG. 12 is a perspective view thereof, with the view showing principally rear features of the assembly.
Figure 13:
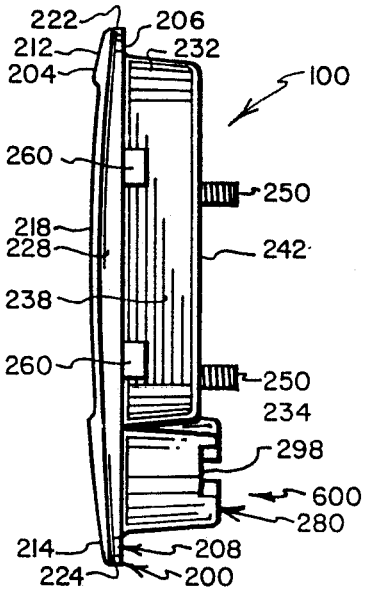
FIG. 13 is a right side elevational view thereof.
Figure 14:
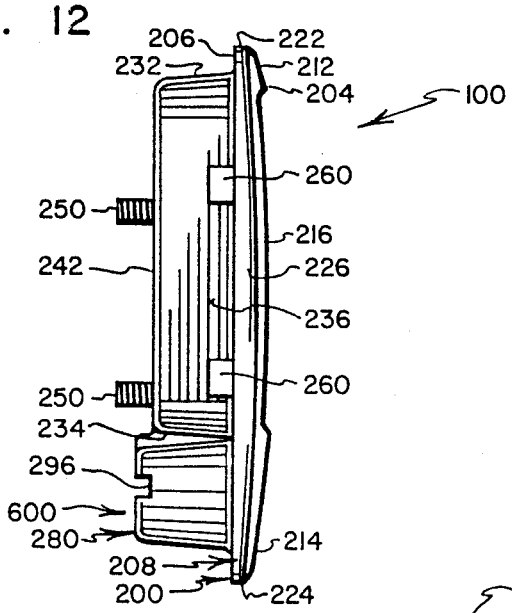
FIG. 14 is a left side elevational view thereof.

Referring to FIG. 7, a shoulder 286 extends substantially radially with respect to the axis 281 to form a transition between the relatively large diameter of the opening 282 and the relatively smaller diameter of the passage 284. Axially extending top and bottom grooves 288 are formed in opposed upper and lower portions of the passage 284. The grooves 288 extend axially rearwardly from the shoulder 286 and have bottom walls 289 that are curved and represent continuations of a cylindrical surface 290 of enlarged diameter that is formed in the rearward end region of the sleeve 280. A radially extending shoulder 292 forms a transition between the passage diameter that is designated by the numeral 284, and the enlarged diameter end region 290. A rounded groove 294 of shallower depth than the grooves 288 is formed in a side of the passage portion 284. The rounded groove 294 extends from the shoulder 286 to the shoulder 292.

Referring to FIG. 24, two opposed portions 296, 298 of the shoulder 292 extend radially outwardly and interrupt opposed side portions of the sleeve formation 280 to provide radially extending, rearwardly opening notches that are designated by the numerals 296, 298.

Figure 3:
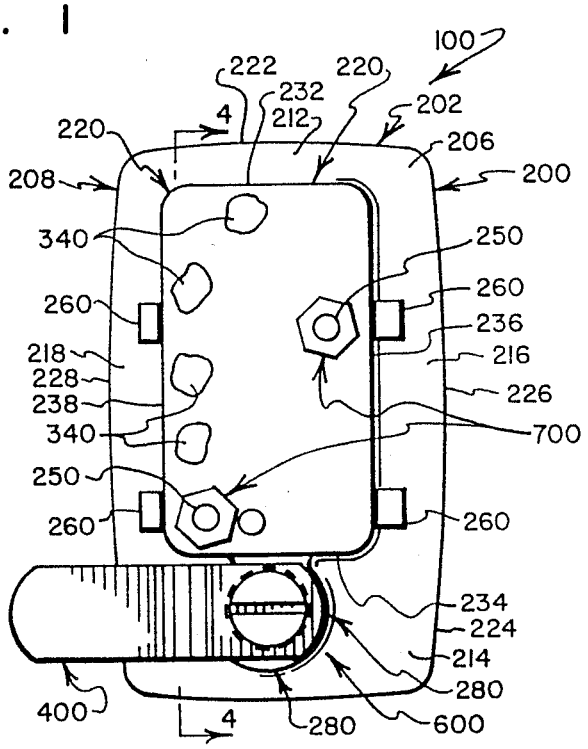
FIG. 3 is a rear elevational view thereof.
Figure 4:
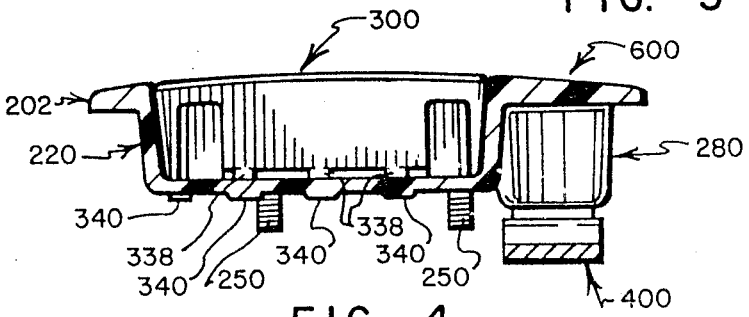
FIG. 4 is a sectional view, as seen from a plane indicated by a line 4—4 in FIG. 3.

In preferred practice, the housing 200 is formed without any openings, holes, slots or the like extending through the walls that define the recess 210, i.e., the top, bottom, and side walls 232, 234, 236, 238, and the back wall 242 are smooth and have no openings formed therethrough. By this arrangement, a wide variety of types of handles as well as latch and lock components of various forms may be utilized with the housing, as is illustrated and described in the referenced Utility and Design cases. Depending on the type of handle that is to be used with the housing 200, and on the type of latch or lock operating mechanism that is to be mounted on the housing 200, one or more suitable passages through the housing 200 are machined in the form of openings, holes, slots and the like which formed as by drilling, milling or other conventional machining techniques. For purposes of mounting the handle and shank assembly 300 on the housing, five holes 336 are formed through the back wall 242 of the housing 200, as is best seen in FIG. 6. The handle 300 has depending leg portions 338 that extend into the holes 336 with at least a plurality of the legs 338 being heat staked to hold the handle 300 in position in the housing 200, as is indicated by the numeral 340 in FIG. 3.

The lock mechanism 600 includes a key cylinder 650 that is installed in the sleeve structure 280 of the housing 200 for selectively permitting and preventing the latch arm 400 from pivoting to effect latching and unlatching movements.

While the lock 100 does not require the presence of a ring-like insert 610 in the back of the housing formation 280, some latches and locks that can be formed using the housing 200 and the handle 300 do require an insert 610. For this reason, reference is made to FIGS. 24 and 25 wherein the latch 100' is depicted which employs the insert 610.

The insert 610 is positioned in the rear end region of the sleeve portion 280 of the housing 200. The insert 610 serves the function of closing rear end regions of the top and bottom grooves 288, and of defining a rearwardly extending stop projection 620 for limiting the range of rotary movement of certain locking members that can be used as a part of the various latch and lock parts that can be used with the housing 200 (examples being the latches and locks disclosed in the other referenced Utility Cases) 600.

From the point of view of molding the housing 200, the use of the insert 610 to close rear end regions of the grooves permits the mold components that form the housing 200 to take a simpler, less expensive form, in that the mold formations that define the grooves 288, 294 all can be withdrawn rearwardly from a newly molded sleeve portion 280, thereby enabling the grooves 288 to be formed with closed end portions without the use of relatively movable mold parts to define interior portions of the sleeve structure, and enabling the sleeve structure to be formed either with or without an accompanying front wall opening.

In order to provide an extension of the rounded groove 294 through the ring-like insert 610, a rounded groove portion 624 is provided in the insert 610 and is aligned with the rounded groove 294 of the sleeve member 280. In order to properly align the ring-like insert for mounting on the housing, a pair of radially extending formations 626, 628 are provided to engage the grooves 296, 298 that are formed at the rear end of the sleeve member 280. The groove 296 and the formation 626 are of relatively small size and are configured to mate in a close slip fit. The groove 298 and the formation 628 are of relatively larger size and are configured to mate in a close slip fit. The difference in sizes of the mating components 296, 626 and 298, 628 prevents inadvertent switch mating of these similarly configured parts. The positioning of the relatively larger formation 628 as well as the rearwardly extending projection 620 at locations adjacent the area of the ring-like insert 610 that is structurally weakened by the provision of the rounded groove 624 serves to strengthen this area of the ring-like insert 610.

Referring to FIG. 5, a key-receiving, tumbler-carrying plug assembly 650 that has an enlarged diameter head portion 652 that is configured to be rotatably received in the front end region of the opening 282, and a substantially constant diameter portion 284 that extends rearwardly from the head portion 652 and is configured to be rotatably received in the central region 284 of the through passage that is formed through the housing portion 280. Radially extensible tumblers 656 form components of the plug assembly 650 and are extensible into the top and bottom grooves 288. An offset cylindrical formation 675 is provided at the rear of the plug 650 for engaging a back face of the insert 610 to hold the plug 650 in place in the housing 200. The plug assembly 650 is insertable into the sleeve 280 by inserting an appropriately configured key (not shown) to retract the tumblers 656, and by aligning the cylindrical formation 675 with the grooves 288 to enable the cylindrical formation 675 to move through the sleeve 280 to a position behind the insert 610. The plug 650 is retained in place on the housing 200 by preventing the cylindrical formation 675 from rotating to a position of alignment with the grooves 624, 294, 2505, which position the plug assembly 650 could be removed from the sleeve 280.

Referring to FIG. 5, it will be seen that tool operated latching plugs 800, 810 can be provided to replace the key operated tumbler assembly 650. The plugs 800, 810 are shaped like the plug 650 and are insertable into the sleeve 280 in the manner described, with offset projection tool receiving hex and slot formations 820, 822 are provided to effect rotation of the plugs 800, 810 without use of a key.

For purposes of providing detents to restrain unwanted rotary movements of the plugs 800, 810, the plugs 800, 810 have bores 804, 814 that carry springs 806, 816 and balls 808, 818 that are based radially outwardly by the springs 806, 816 to engage the grooves 288.

Also shown in FIG. 5, are alternate forms 400', 400'' of the latch arm 400 that may be employed. Other configurations can be used, as will be apparent to those skilled in the art.

In FIG. 6, a non-latching, non-locking form of the handle 300 and the housing 200 is shown which differs from the embodiments described above in that a simple disc-like plug 990 is provided to close the front wall opening 282.

Also, two forms of mounting brackets 750, 750' are shown that can be used has been described in conjunction with the embodiment 750.

In FIGS. 18–23, the provision of a pull 100''' that uses housing embodiment 200''' that is identical to the embodiment 200 except for the absence of a front wall opening 282 is disclosed. The housing embodiment 200' can be used in place of the housing embodiment 200 in many applications where no locking or latching action is to be provided.

Although the invention has been described in its preferred form with a certain degree of particularity, it is understood that the present disclosure of the preferred form has been made only by way of example, and that numerous changes in details of construction as well as the combination and arrangement of parts may be made without departing from the spirit and scope of the invention as hereinafter claimed. It is intended that the patent shall cover by suitable expression in the appended claims, whatever features of patentable novelty exist in the invention disclosed.

What is claimed is:

1. A flush-mountable latch, comprising:

(a) housing means including a one-piece pan-shaped housing having a front wall, and having recess-defining wall formations that define a forwardly facing recess, with portions of the front wall forming a mounting flange that surrounds the recess;

(b) the one-piece housing being formed from plastics material as a rigid, molded structure, with the recess-defining wall formations including a back wall at the rear of the recess, and with the back wall defining a rearwardly facing, substantially planar mounting surface;

(c) mounting means rigidly connected to the back wall of the one-piece housing including first and second mounting studs formed from metal, with each of the mounting studs having an elongate, generally cylindrical body with opposed end regions, with an enlarged head formation being defined on one end region of the body, and with a threaded shank being defined on the other end region of the body, with the enlarged head regions of the first and second mounting studs being embedded within the molded plastics material that defines the back wall to provide a rigid connection between the mounting stud and the back wall, with the generally cylindrical bodies of the first and second mounting studs being oriented such that their axes extend substantially parallel to each other and through the mounting surface in directions that are substantially perpendicular to the plane of the mounting surface, and with the threaded shanks projecting rearwardly from the mounting surface at spaced locations on opposite sides of the mounting surface;

(d) handle means including a handle nested within the recess and being connected rigidly to the housing;

(e) latch bolt means connected to the housing for movement relative to the housing between latched and unlatched positions; and, (f) latch operator means movably connected to the housing at a location external to the recess and being accessible through the front wall for moving the latch bolt means between its latched position and its unlatched position.

2. The latch of claim 1 wherein the front wall has a front surface that extends in a smooth convex curve, with the thickness of the front wall portions that define the mounting flange differing across the front wall, with maximum thickness being provided where the front wall portions join with the recess-defining wall formations so as to form strong junctures between the front wall and the recess-defining wall formations all along the juncture of the recess-defining wall formation with the front wall.

3. The latch of claim 2 wherein the handle is formed as a rigid, one piece molded structure, the handle has a front wall that has a front surface, and the front surface of the handle is configured to extend contiguously with front surface portions of the housing.

4. The latch of claim 3 wherein the housing and the handle are formed from an injection molded, glass reinforced, polycarbonate based polymer blend thermoplastics material.

5. The latch of claim 1 wherein such portions of each of the first and second mounting studs as are embedded within the molded plastics material of the back wall include a generally annular, radially outwardly extending projection that extends into the molded plastics material at locations spaced from its associated enlarged head formation.

6. A combination lock and latch housing, comprising:

(a) a one-piece housing formed from injection molded thermoplastics material that is selected to provide a strong, rigid, impact resistant structure that is readily machineable, with the one-piece structure including as integral parts thereof:

(i) a front wall;

(ii) a back wall located behind the front wall;

(iii) rearwardly extending wall portions that join with the front and back walls, and that cooperate with the back wall to define a forwardly facing recess that opens through the front wall;

(iv) a mounting flange that is defined by the front wall and that extends in an uninterrupted manner perimetrically about about the recess;

(v) rearwardly facing mounting surface means defined by the back wall including a substantially planar back wall surface for mounting and guiding the movement of such relatively movable lock and latch components as may be secured to the housing;

(b) the rearwardly extending wall portions of the one-piece housing including opposed top and bottom walls that define opposite ends of the recess, and including opposed side walls that define opposite sides of the recess; with the side walls extending in planes that are located substantially equidistantly from and on opposite sides of an imaginary center plane of the recess, and that extend substantially parallel to the center plane; and, with the top and bottom walls extending in spaced, substantially parallel planes that intersect the planes of the side walls substantially perpendicularly;

(c) mounting means rigidly connected to the back wall of the one-piece housing including first and second mounting studs formed from metal, with each of the mounting studs having an elongate, generally cylindrical body with opposed end regions, with an enlarged head formation being defined on one end region of the body, and with a threaded shank being defined on the other end region of the body, with the enlarged head regions of the first and second mounting studs being embedded within the molded plastics material that defines the back wall to provide a rigid connection between the mounting stud and the back wall, with the generally cylindrical bodies of the first and second mounting studs being oriented such that their axes extend substantially parallel to each other and through the mounting surface in directions that are substantially perpendicular to the plane of the mounting surface, and with the threaded shanks projecting rearwardly from the mounting surface at spaced locations on opposite sides of the mounting surface for connection with pull, latch and lock components to mount such components on the housing;

(d) sleeve means defined by the housing including a generally cylindrical formation of the one-piece housing that is located adjacent a selected one of the end walls that defines an end of the recess;

(e) the front wall of the housing extending adjacent one end region of the sleeve means and providing a machinable surface portion that closes the one end region of the sleeve, but which can have an opening formed therethrough as by machining to provide a through passage that extends through the sleeve means and opens through the front wall of the housing for enabling the housing to journal latch and lock components within the through passage; and, (f) groove means formed in the sleeve means for facing into such a through passage for receiving and releasably retaining locking elements such as tumblers of a key cylinder assembly, and for receiving and releasably retaining a detent formation such as a spring-projected ball detent carried by a rotary plug assembly.

7. The housing of claim 6 wherein the injection molded plastics material is a glass reinforced polycarbonate based polymer blend.

8. The housing of claim 6 wherein such portions of each of the first and second mounting studs as are embedded within the molded plastics material of the back wall include a generally annular, radially outwardly extending projection that extends into the molded plastics material at locations spaced from its associated enlarged head formation.

9. A housing, handle and mounting bracket assembly, comprising:

(a) a one-piece pan-shaped housing formed from molded plastics material having a front wall, and having wall portions that are located behind the front wall for defining a forwardly-facing recess that opens through the front wall, with the front wall having portions that extend perimetrically around the recess to define a mounting flange;

(b) the recess defining walls of the one-piece housing including a back wall having a substantially flat rearwardly facing mounting surface that extends substantially within a common plane, with mounting means rigidly connected to the back wall and projecting rearwardly therefrom, including first and second mounting studs formed from metal, with each of the mounting studs having an elongate, generally cylindrical body with opposed end regions, with an enlarged head formation being defined on one end region of the body, and with a threaded shank being defined on the other end region of the body, with the enlarged head regions of the first and second mounting studs being embedded within the molded plastics material that defines the back wall to provide a rigid connection between the mounting stud and the back wall, with the generally cylindrical bodies of the first and second mounting studs being oriented such that their axes extend substantially parallel to each other and through the mounting surface in directions that are substantially perpendicular to the plane of the mounting surface, and with the threaded shanks projecting rearwardly from the mounting surface at spaced locations on opposite sides of the mounting surface;

(c) a pair of elongate mounting posts threaded onto the threaded shanks for providing threaded mounting formations at locations spaced behind the back wall formations for connection to a mounting bracket at said locations spaced behind the back wall;

(d) a U-shaped mounting bracket having a central leg that interconnects a pair of forwardly extending end legs, with the center leg overlying the back wall of the housing, and with the forwardly extending legs projecting toward mounting flange portions at opposed end regions of the housing, and with first and second holes formed through the central leg at said locations spaced behind the back wall;

(e) first and second threaded fastener means for extending through said first and second holes and for being threadedly connected to the threaded mounting formations at said locations spaced behind the back wall;

(f) hole means formed through the recess-defining walls;

(g) a handle for positioning in the recess; and, (h) rearwardly extending post portions formed on the handle as an integral part thereof, with at least a plurality of the post portions being extensible through the hole means formed in the housing and being heat deformable so as to provide a means for rigidly connecting the handle to the housing.

10. The assembly of claim 9 additionally including latch formation means carried by the housing and including operator means connected to the housing and being movable relative to the housing and the handle for effecting latching and unlatching movements of the latch formation means.

11. The assembly of claim 10 wherein the latch formation means includes a pivotally mounted latching arm that is movable between latched and unlatched positions.

12. The assembly of claim 10 wherein the operator means includes a rotatable plug that is connected to the housing, and the latch formation includes a resilient, expansible latching element that is expansible by rotating the rotatable plug.

13. The assembly of claim 9 wherein the recess is of generally rectangular shape having a length that is longer than its width, and the mounting bracket extends transversely across the length of the recess.

14. The assembly of claim 9 wherein the recess is of generally rectangular shape having a length that is longer than its width, and the mounting bracket is an elongate structure that extends parallel to the length of the recess.

15. The assembly of claim 9 wherein such portions of each of the first and second mounting studs as are embedded within the molded plastics material of the back wall include a generally annular, radially outwardly extending projection that extends into the molded plastics material at locations spaced from its associated enlarged head formation.

16. A universal housing assembly for mounting on a closure or the like, and for providing a plurality of mounting stations for selectively connecting the housing assembly to pull, latch and lock components, comprising:

(a) housing means including a housing formed as a rigid, one-piece structure from injection molded plastics material, and having as integrally formed portions thereof:

(i) front wall means for defining a relatively thin front face of the one-piece housing with boundaries thereof being defined by a pair of relatively long opposed edge surfaces, and a pair of relatively shorter edge surfaces that interconnect the relatively long edge surfaces and that cooperate therewith to provide the housing with a generally rectangular shape as viewed from a front side thereof, and with the front wall means having a rearwardly facing mounting surface for overlying a forwardly facing surface of a closure or the like on which the housing means is to be mounted;

(ii) recess defining means for defining a forwardly facing recess that opens through the front wall, with the recess being defined by a pair of relatively long opposed side walls and a pair of relatively shorter opposed end walls that cooperate to give the recess a generally rectangular shape as viewed from a front side thereof, and with the recess defining further including a back wall means of generally rectangular shape as viewed from a front side thereof, with the back wall means defining a substantially planar, rearwardly facing component positioning station in engagement with which latch and lock components can be positioned for being connected to the housing at desired locations relative thereto;

(b) the front wall means having portions thereof that extend perimetrically around the recess defining means for providing a mounting flange that borders the recess, and with the width of the mounting flange means differing adjacent the opposed end walls so as to provide a relatively wider mounting flange portion adjacent one of the end walls than is provided adjacent the other of the end walls;

(c) mounting means rigidly connected to the back wall of the one-piece housing including first and second mounting studs formed from metal, with each of the mounting studs having an elongate, generally cylindrical body with opposed end regions, with an enlarged head formation being defined on one end region of the body, and with a threaded shank being defined on the other end region of the body, with the enlarged head regions of the first and second mounting studs being embedded within the molded plastics material of the back wall means to provide a rigid connection between the mounting stud and the back wall means, with the generally cylindrical bodies of the first and second mounting studs being oriented such that their axes extend substantially parallel to each other through the mounting surface in directions that are substantially perpendicular to the plane of the mounting surface, and with the threaded shanks projecting rearwardly from the mounting surface at spaced locations on opposite sides of the mounting surface for securely attaching latch and lock components that are positioned in contact with the back wall means of the housing;

(d) elongate mounting post means threaded onto the threaded shanks and extending rearwardly with respect to the housing for defining at least one mounting position at a location extending along the length of the mounting post means, and with the mounting post means being configured at said one mounting position for connection to said latch and lock components to mount such components on the housing;

(e) threaded fastener receiving formation means provided on a rearward end region of the mounting post means for defining an additional mounting station on which components can be connected to the housing;

(f) mounting bracket means for overlying the back wall means and having holes formed therethrough for aligning with the threaded fastener receiving formation means, with portions of the mounting bracket means being configured for engaging a closure or the like on which the housing is to be mounted; and, (g) threaded fastener means for extending through the holes formed in the mounting bracket means and for threadedly connecting with the threaded fastener receiving formation means for attaching the mounting bracket means to the elongate post means.

17. The assembly of claim 16 additionally including handle means for positioning in the recess and for connection to the housing, with the handle means having a forwardly facing surface that extends substantially contiguously with the front face of the housing means when the handle means is at a position nested in the recess.

18. The assembly of claim 17 wherein the front face of the housing means has a complexly curved, substantially convex configuration that causes the front wall to vary in thickness in directions toward and away from an imaginary center point of the front wall that is located midway between the relatively longer edge surfaces and the relatively shorter edge surfaces, with the variation in thickness being such that in moving relatively toward said imaginary center point, wall thickness is found to increase, whereas, in moving relatively away from said imaginary center point, the wall thickness is found to decrease.

19. The structure of claim 16 wherein the edge surface portions that extend about the perimeter of the front wall are of substantially uniform thickness around the entire perimeter thereof.

20. The structure of claim 18 wherein the front wall of the handle has a front face that conforms to the complexly convex curvature of the front wall so as to provide a substantially smooth continuation thereof on forwardly facing portions of the handle.

21. The latch of claim 16 wherein:

(a) the housing has a generally cylindrical sleeve-like portion formed integrally with the front wall and defining a through passage that opens through the front wall, with the through passage having an inner wall surface that is of generally cylindrical configuration and and extends substantially perpendicularly to the common plane of the rearwardly facing mounting flange surface portions;

(b) at least one groove is formed in the inner wall surface of the through passage;

(c) a plug is configured to fit with the through passage and is journaled therein for rotation about the imaginary axis;

22. The assembly of claim 16 wherein such portions of each of the first and second mounting studs as are embedded within the molded plastics material of the back wall include a generally annular, radially outwardly extending projection that extends into the molded plastics material at locations spaced from its associated enlarged head formation.

23. A flush-mountable lock, comprising:

(a) pan-shaped housing with a forwardly facing recess surrounded by a mounting flange that has a front face and a rear face, with the housing also having a locking plug mounting location defined adjacent the recess by means of a generally sleeve-like structure which has a through passage that opens through the front face of the mounting flange;

(b) the housing being formed as a one-piece structure from injection molded plastics material and having a back wall at the rear of the forwardly facing recess, with the back wall closing the rear of the recess, and defining a substantially planar mounting surface on the back of the housing, with mounting means rigidly connected to the back wall of the one-piece housing including first and second mounting studs formed from metal, with each of the mounting studs having an elongate, generally cylindrical body with opposed end regions, with an enlarged head formation being defined on one end region of the body, and with a threaded shank being defined on the other end region of the body, with the enlarged head regions of the first and second mounting studs being embedded within the molded plastics material of the back wall to provide a rigid connection between the mounting stud and the back wall, with the generally cylindrical bodies of the first and second mounting studs being oriented such that their axes extend substantially parallel to each other and through the mounting surface in directions that are substantially perpendicular to the plane of the mounting surface, and with the threaded shanks projecting rearwardly from the mounting surface at spaced locations on opposite sides of the mounting surface;

(c) handle means including a handle that is rigidly connected to the housing;

(d) latch bolt means connected to the housing for movement relative to the housing between latched and unlatched positions; and, (e) latch operator means movably connected to the housing at a location external to the recess and being accessible through the front wall for moving the latch bolt means between its latched position and its unlatched position.

24. The latch of claim 23 wherein the front wall has a front surface that extends in a smooth convex curve, with the thickness of the front wall portions that define the mounting flange differing across the front wall, with maximum thickness being provided where the front wall portions join with the recess-defining wall formations, so as to form strong junctures between the front wall and the recess-defining wall formations all along the juncture of the recess-defining wall formation with the front wall.

25. The latch of claim 24 wherein the handle is formed as a rigid, one piece molded structure, the handle has a front wall that has a front surface, and the front surface of the handle is configured to extend contiguously with front surface portions of the housing when the handle is in its non-operated position.

26. The latch of claim 25 wherein the housing and the handle are formed from an injection molded, glass reinforced, polycarbonate based polymer blend thermoplastics material.

27. The latch of claim 23 wherein the housing additionally has, formed integrally therewith, a plurality of locator projections that extend rearwardly from the rearwardly facing mounting flange surface at junctures of the rearwardly facing mounting flange surface with recess-defining wall portions.

28. The latch of claim 23 wherein such portions of each of the first and second mounting studs as are embedded within the molded plastics material of the back wall include a generally annular, radially outwardly extending projection that extends into molded plastics material at locations spaced from its associated enlarged head formation.

* * * * *